United States Patent [19]

Ostrow

[11] 3,960,637

[45] June 1, 1976

[54] COMPOSITE STRUCTURAL MEMBER

[76] Inventor: Paul F. Ostrow, 3170 SW. Fairmount Blvd., Portland, Oreg. 97201

[22] Filed: July 23, 1973

[21] Appl. No.: 381,912

[52] U.S. Cl. ..... 156/293 R; 29/155; 29/525; 52/729; 52/730

[51] Int. Cl.[2] ..... E04C 3/292

[58] Field of Search ..... 29/155, 509, 522, 514, 29/470.5; 156/293; 52/729, 730, 731, 753 B, 753 G

[56] References Cited

UNITED STATES PATENTS

| | | | |
|---|---|---|---|
| 533,203 | 1/1895 | Stange | 52/753 B |
| 727,862 | 5/1903 | Taylor | 52/753 B |
| 941,375 | 11/1909 | Load | 52/753 B |
| 1,163,784 | 12/1915 | Skinner | 52/730 |
| 1,212,073 | 1/1917 | Krueger | 52/730 |
| 1,445,470 | 2/1923 | Bale | 52/753 B |
| 1,638,648 | 8/1927 | Trotter | 29/522 |
| 1,911,413 | 5/1933 | Wait | 29/155 |
| 1,989,955 | 2/1935 | Van Patter | 29/522 |
| 2,237,329 | 4/1941 | Bischof | 29/522 |
| 2,981,669 | 4/1961 | Brand | 29/522 |
| 3,272,684 | 9/1966 | Moore | 156/293 |
| 3,477,485 | 11/1969 | Talbott | 29/155 R |

FOREIGN PATENTS OR APPLICATIONS

| | | | |
|---|---|---|---|
| 691,335 | 7/1964 | Canada | 52/730 |
| 101,084 | 2/1965 | Denmark | 52/729 |
| 1,164,627 | 5/1964 | Germany | 52/729 |
| 252,881 | 4/1927 | Italy | 29/155 |
| 140,019 | 4/1953 | Sweden | 52/729 |
| 437,720 | 11/1967 | Switzerland | 52/729 |

*Primary Examiner*—Ernest R. Purser
*Assistant Examiner*—H. E. Raduazo
*Attorney, Agent, or Firm*—Kolisch, Hartwell, Dickinson & Stuart

[57] ABSTRACT

A composite building component including a center web and opposed elongate flange elements united to opposed edge margins of the web. The edge margins of the web seat within web-receiving channels defined in the flange elements, and are compressed through the act of inserting the margins into the channels during the assembly of the component. An adhesive bonds the edge margins in place within the channels. A method of making a composite building component comprising a web and flange elements united to opposed edge margins of the web.

3 Claims, 10 Drawing Figures

14
12
10
12A 14A
4
30
34
12B
20
36
14B
12C'
48
46

12B'
12B
20
26
22
22
36
24
14B
28

20C
45
42
50
44
40
24C
14C

62'
12F'
20D
55
40D
14D 12F
20F
62

12E
20E
40E
14E 12G
14G 14H
66
68

COMPOSITE STRUCTURAL MEMBER

This invention relates to a composite building component of the type that might be used, for instance, in lieu of a conventional wooden beam in the construction industry.

While the use of wooden timbers as structural members has been common in the past in the construction industry, in more recent times sole reliance on such a material introduces a number of complications. For instance, the price of lumber has been subject to extreme and rapid fluctuations. Furthermore, with the depletion of stands of mature timber, the supply of certain types of lumber products becomes uncertain. These and other considerations have indicated the need of a composite building component, capable of being constructed according to various designs depending upon the strength properties desired, which makes efficient utilization of the elements going into the component, whether such be wood or a substitute material.

The building component of the invention comprises an elongate web, which may be a continuous piece of material or in some instances separate web pieces abutting or spaced from each other along the length of the component, and an elongate reinforcing flange element united to an edge margin of this web, preferably to each of the opposed edge margins of the web. Each flange element has a web-receiving channel defined therein extending along a side thereof, shaped compressibly to deform the edge margin of the web when the edge margin is inserted into the channel during the assembly of the component. The material of the web furthermore is selected to have a degree of compressibility therein, in a direction normal to the sides thereof, to accommodate this compressive deforming of an edge margin. With an adhesive present to bond an edge margin to the flange element, and with the compressive deformation which occurs in the web in assembling the web and flange element, a superior type of joint is achieved uniting the flange element and web. This is obtained without the use of clamps or other devices for holding the parts as the adhesive sets.

In constructing a building component, a number of different materials may be used for the flange elements and web described, with the particular materials employed depending upon their availability and the strength properties desired in the component. For instance, the component may be manufactured from a composite of wooden and metal parts, employing extruded or otherwise shaped metal flange elements united to a central wooden web extending between and joining these flange elements. The metallic flange elements have sufficient strength compressively to deform the relatively compressible edge margins of the wooden web when they are inserted into the web-receiving channels of the flange elements. Illustrating another form of the invention, the center web may be a corrugated metallic sheet, having a degree of compressibility introduced therein by the corrugations, with edge margins received within channels of opposed metallic, or possibly wooden flange elements, the means defining such channels having proper strength to produce compressive deformation of the edge margins when they are inserted into the channels.

A general object of the invention, therefore, is to provide an improved composite building component featuring a web united to a flange element where such flange element has a channel receiving an edge margin of the web.

Another object is to provide such a building component, where the edge margin of the web is adhesively bonded to the flange element, the bond setting up or curing under a compressive fit produced during the assembly of the component when an edge margin of the web is fitted within a web-receiving channel defined in the flange element.

Another object of the invention is to provide a novel method of making a composite building component.

A further object of the invention is to provide a novel building component, as well as a method for making it, which is capable of utilizing a variety of materials in the composition of the web and the flange elements that are united together in the component.

These and various other objects and advantages will become more fully apparent as the following description is read in conjunction with the accompanying drawings, wherein.

Figures 1, 2, 3, 4, 5, 6, 7, 8, 9, 10:
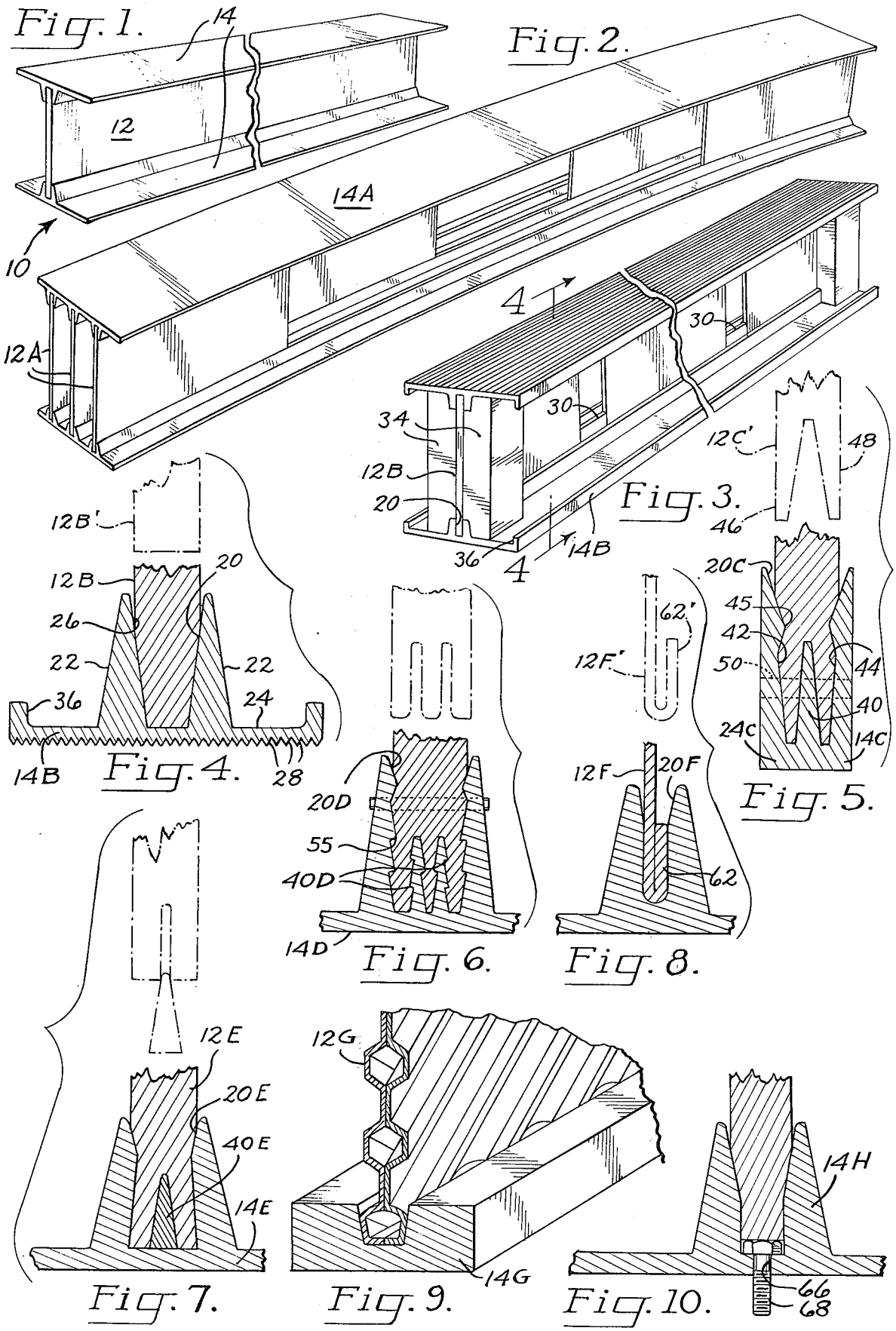
FIGS. 1 and 2 illustrate in perspective views, two modifications of a building component constructed according to the invention.
FIG. 3 is a perspective view illustrating another modification of the invention.
FIG. 4 is a cross-sectional view of portions of the component shown in FIG. 3, on an even larger scale, and illustrating how an edge margin of the web is united to a flange element as contemplated herein.
FIGS. 5, 6, 7 and 8 are cross-sectional views of portions of other modifications of the invention, showing modified forms of flange elements, and methods of joinder with an edge margin of a web.
FIG. 9 is a perspective view illustrating a still further modification of the invention.
FIG. 10 is a cross-sectional view of portions of yet another modification of the invention.

Referring to the drawings, a building component as contemplated herein comprises, as illustrated by component 10 in FIG. 1, an elongate web 12, and united to at least one and preferably both of the opposed edge margins of the web, elongate flange elements, shown at 14.

The building component may take any number of different forms. For instance, in FIG. 1 the component resembles somewhat in appearance the conventional "I" beam. In another form the web, instead of being of uniform width along the component as in FIG. 1, may be selected to have a gradually increasing width. In another form of the invention, as shown in FIG. 2, multiple parallel webs 12A are provided extending between and united at their opposed margins to arcuately curved flange elements 14A. While certain structural shapes have briefly been described, it should be obvious that such may take a number of different forms depending upon the use intended, strength properties desired, and other considerations.

The web bounded by the flange elements may be a continuous planar piece, as exemplified by web 12 in FIG. 1. Alternatively, the web may be formed up of plural web pieces set end to end. The pieces may be located with their end edges abutting, or in spaced apart relation, as demonstrated by the pieces making up the webs 12A shown in FIG. 2.

Referring now to FIGS. 3 and 4, in the building component shown, opposed edge margins of central web 12B are seated within web-receiving channels 20 defined along the sides of the flange elements which face the web in the component. Thus, and considering a flange element 14B in FIGS. 3 and 4, extending along the inner side of the flange element are opposed shoulders 22 integrally joined to what is referred to herein as a base 24 of the flange element. Channel 20 is defined between the inner sides 26 of shoulders 22.

A flange element may be prepared in a number of ways. For instance, it may be extruded, shaped, cut, rolled or otherwise formed of materials such as metal, fiberglass, plastic, etc. The selection of material is dependent to some extent upon the composition of the web which is united with the flange element since, as will be more fully described, the margin of the web is united with the flange element through compressive deformation of this margin. Thus, the flange element must have a strength which will produce this compressive deformation.

In the form of the invention shown in FIGS. 3 and 4, a web has been pictured which is of wood such as plywood. The flange elements 14B may be of extruded metal such as aluminum. The extrusion is prepared with shoulders 22 having sides 26 defining the channel that converge on each other slightly progressing toward the base of the channel from the top of the channel. In this way, a tapered entry zone is defined progressing into the channel from the channel's top. The shoulders, furthermore, are of somewhat larger thickness adjacent base 24 than adjacent the top of the shoulders, to provide the strength whereby proper compression of the wooden web may be produced.

An edge margin of web 12B before insertion into channel 20 has the cross-sectional shape indicated in dashed outline at 12B' in FIG. 4. Thus, the edge margin has a thickness which is less than the width of the channel at the top of the channel. The width of the edge margin, however, is somewhat less than the thickness of the channel adjacent the base of the channel. With the assembly of the component, the edge margin of the web is forced laterally downwardly into channel 20, with the edge margin when fully seated in the channel compressibly deforming to have the profile indicated for the web as shown in solid outline in FIG. 4. In other words, the wooden web is to a degree compressible in a direction extending normal to its sides, and through the act of inserting the edge margin into the channel, and by reason of the cross-sectional profile of the channel selected, the edge margin is deformed whereby such assumes the shape indicated.

In uniting an edge margin to the flange element, an adhesive also may be employed. This may be deposited in the channel prior to driving of the edge margin of the web into position, or alternatively, coated on the edge margin of the web to be carried into the channel with insertion of the edge margin into the channel. Such adhesive, as exemplified by an epoxy resin which is usable in uniting a wooden web to an aluminum flange element, on setting or curing produces a solid bond between the two parts. The curing takes place with the abutting surfaces being bonded under compression, important in obtaining maximum strength in the final joint that is produced.

In the building component shown in FIGS. 3 and 4, it will be noticed that the side of base 24 in the flange element which faces outwardly is ribbed, as at 28. By so surfacing outwardly facing sides, a nonskid surface is presented along the component, of utility in firmly anchoring other structural elements which bear against the component in a building construction.

If desired, and to add further strength to the component when spaced web pieces are utilized in the web as shown in FIG. 3, reinforcements 30 may be included seating within the channels 20. These may be adhesively secured in place, or alternatively fastened to the shoulders of a flange element as with pins or other fasteners.

With further reference to FIG. 3, in certain applications the ends of a component may be reinforced as by mounting blocks 34 between the flange elements, with such extending on either side of the web. A set of such blocks may be included at each end of the component. These may be secured in place, as with an adhesive, or with pins.

With further reference to FIG. 4, it will be noted that along opposite margins of base 24 in a flange element turned over shoulders 36 have been provided. These shoulders serve to strengthen the flange element by inhibiting bending therein.

Referring now to FIG. 5, this figure illustrates in cross section, portions of a modified form of building component. In this instance, flange element 14C includes a channel 20C which is divided at its base by a tapered wedge portion 40 projecting upwardly from the floor of the channel and integral with base 24C. This wedge portion may extend along the length of the channel, and divides the base of the channel into channel regions 42, 44. Note also that the sides defining the channel 20C, progressing downwardly toward the base of the channel, incline inwardly until a region 45 is reached, then flair outwardly slightly, and then continue to incline inwardly. In this way, at region 45, elongate compressive pads are defined protruding into the channel, which introduce a higher degree of compression in the web margin at the location of the pads than a zone spaced toward the base of the channel from the pads.

The web margin which is fitted within channel 20C in FIG. 5 is shaped before insertion into the channel as shown in dashed outline at 12C', i.e., with a cut made therealong to divide the web margin into portions 46, 48. These portions locate themselves on either side of wedge portion 40 with the edge margin inserted into channel 20C. Again, fitting of the edge margin is done with compression of the web, and the union with flange element 14C is made with the inclusion of an adhesive which cures or sets under this condition of a compressive fit.

In the modification in FIG. 5, a pin is shown at 50 exemplary of pins or other fasteners which additionally may be included at intervals along the length of the flange element, further to anchor the flange element and web together.

In FIG. 6, where a still further modification of the invention is illustrated, a flange element 14D is illustrated having a channel 20D which is divided adjacent the base of the channel by two wedge portions 40D. Note also that the sides of channel 20D and wedge portions 40D may be provided with elongate ribs or striations 55. By irregularly contouring these sides in this manner, catch regions are formed increasing the strength of the union between the web portion and the flange element.

The wedge portions shown in FIGS. 5 and 6 perform the function of introducing compression to an edge margin from a region internally of the edge margin. They also provide additional surfaces through which the edge margin of a web may be bonded to a flange element in making a joint.

In the modification of the invention shown in FIG. 7, the flange element 14E is provided with a channel 20E with sides that incline inwardly slightly progressing downwardly from the top of the channel as in other modifications of the invention discussed. In making a joint with the edge margin of the web 12E, a wedge portion 40E may be employed which is separate from and not an integral part of flange element 14E. Again, however, as in the modification of the invention discussed with reference to FIG. 5, with the edge margin of the web forced into a seated position, the wedge portion serves to produce a compressive fit with the edge margin in a finally seated position.

In FIG. 8, a modification of the invention is shown wherein the margin of the web 12F includes the turned-over expanse 62. The web in this instance may be made of metal or other deformable material. Prior to mounting of the web margin in channel 20F of the flange element, the turned-over expanse is as illustrated for the web shown in dashed outline at 12F', the expanse 62' being spaced somewhat from the remainder of the web. With insertion of the edge margin into the channel 20F a constrictive force is applied producing compression of the edge margin. Again, as in other embodiments, an adhesive bond may be utilized in completing the joint between the web and the flange element.

FIG. 9 illustrates yet another modification of the invention. Here the web 12G comprises corrugated sheets placed face to face. By reason of the nonplanar faces present in the web, a degree of deformability or flattenability is introduced, permitting compressive deformation of an edge margin of this web when fitted into flange element 14G. With the web 12G made of light metal for instance, and relatively easily deformed, the flange element 14G might be made of wood or material other than metal.

FIG. 10 illustrates in cross section yet another modification of the invention. In this instance the flange element 14H may be provided with bores 66 which are distributed at spaced intervals along the length of the flange element. These receive fasteners such as the bolts 68 pictured, having threaded ends which project below the base of the flange element. These fasteners may be utilized in mounting of the building component when the building component is installed.

It should be apparent from the above that the building component contemplated may take a variety of different forms. While a number of different modifications have been described herein, it is not intended by this description to be specifically limited to such modifications, as other variations and forms of the component would be obvious to one skilled in the art.

It is claimed and desired to secure by Letters Patent:

1. A method of making an elongate building component comprising a web element and an elongate flange element united to an edge margin of said web element, the method comprising providing a flange element with an elongate channel defined along a side thereof, said channel, progressing toward the base of the channel from the top thereof having sides that converge on each other to form opposed pads in one elongate zone extending the length of the channel and that thence diverge in a region spaced toward the base of the channel from said zone, providing a web element with an edge margin which is compressible in a direction normal to the sides thereof, which edge margin is of lesser thickness than the width at the top of the channel but has a greater thickness than the width of the channel in said zone of opposed pads, introducing adhesive to one of said elements whereby such will reside in said channel with said edge margin seated in said channel, inserting said edge margin into said channel by forcing such laterally into the channel to seat the edge margin with such extending past said zone of said pads, and as a result of said insertion, and with the edge margin so seated, permanently compressing the edge margin of said flange element with said pads, where the edge margin extends across the zone of said pads, to a thickness which is less than the original thickness of said edge margin and less than the thickness of the edge margin on either side of said pads.

2. The method of claim 1, wherein the sides of said channel, progressing toward the base of the channel and after diverging in said region, converge again on each other in another zone, the edge margin of said web element has a greater thickness than the width of the channel in said other zone, and said insertion is done so as to extend said edge margin into said other zone, and as the result of said insertion the edge margin of said flange element is compressed by the sides of said channel in said other zone to a thickness which is less than the original thickness of said edge margin.

3. The method of claim 2, wherein during the insertion of said edge margin an elongate divider is inserted into the edge margin with such divider paralleling the length of the channel and becoming lodged within the edge margin in a region located between the sides of the edge margin and toward the base of the channel from said first-mentioned zone, and said divider cooperating with the sides of said channel to produce compressive deformation of said edge margin in a region located below where said edge margin is compressively deformed by said pads.

* * * * *